United States Patent [19]

Erani

[11] Patent Number: 4,662,116

[45] Date of Patent: May 5, 1987

[54] GRINDING ATTACHMENT

[75] Inventor: Homi K. Erani, Aberdeen, S. Dak.

[73] Assignee: K. O. Lee Company, Aberdeen, S. Dak.

[21] Appl. No.: 771,267

[22] Filed: Aug. 30, 1985

[51] Int. Cl.[4] ..... B24B 21/00

[52] U.S. Cl. ..... 51/3; 51/135 R; 51/148; 51/262 A; 51/273

[58] Field of Search ..... 51/3, 72 R, 74 R, 76 R, 51/78, 135 R, 137, 138, 139, 140, 143, 148, 262 A, 273

[56] References Cited

U.S. PATENT DOCUMENTS

| | | | |
|---|---|---|---|
| 95,265 | 9/1869 | Randolph | 51/135 R X |
| 996,443 | 6/1911 | Wysong | 51/140 |
| 2,365,584 | 12/1944 | Newswanger | 51/135 R |
| 2,597,256 | 5/1952 | Murray | 51/148 X |
| 2,723,513 | 11/1955 | Slonneger | 51/135 R X |
| 3,269,065 | 8/1966 | Nylund | 51/140 |
| 3,760,538 | 9/1973 | Solheim | 51/148 |
| 3,889,429 | 6/1975 | Zuercher | 51/273 X |
| 4,192,104 | 3/1980 | Patenaude | 51/273 |
| 4,501,044 | 2/1985 | Schulze et al. | 51/273 X |

FOREIGN PATENT DOCUMENTS

| | | | |
|---|---|---|---|
| 586682 | 11/1959 | Canada | 51/148 |
| 607083 | 6/1926 | France | 51/143 |

*Primary Examiner*—Robert P. Olszewski

*Attorney, Agent, or Firm*—Dorsey & Whitney

[57] ABSTRACT

The present invention is a grinding attachment (10) which can be utilized as either a belt grinder or a disc or wheel grinder. The attachment (10) includes a housing (14) enclosing a drive spindle (56) to which either a grinding wheel (114) or a contact wheel (62) can be mounted. If the apparatus is to be used as a disc or wheel grinder, the grinding wheel (114) is affixed. If the apparatus is to be used as a belt grinder, the contact wheel (62) is affixed. The apparatus can easily be interchangeably reconfigured between the two configurations. When in a belt grinder configuration, the attachment (10) includes means within the housing (14) for enabling the extension of the life of a grinding belt (52) by providing various idlers (70, 72, 78) about which the belt (52) can be fed in order to maximize the length of belt within the limited space provided by the housing (14).

2 Claims, 4 Drawing Figures

GRINDING ATTACHMENT

TECHNICAL FIELD

The present invention is broadly related to the field of apparatus for effecting the grinding of various work pieces. More narrowly, however, the invention deals with such apparatus employable as either a wheel grinder or a belt grinder. A preferred embodiment of the invention focuses upon an application of the invention wherein it is used as a belt grinder.

BACKGROUND OF THE INVENTION

Machine tool parts are used extensively in industry throughout the world. Machining of such parts can be accomplished in numerous ways and utilizing various types of apparatus. The particular tool employed is a function of the type of part to be manufactured, its ultimate intended purpose, and other factors.

While some components of this type are formed utilizing a die, others can be cast. In either case, however, burrs and flashing can be a by-product of the forming process. These phenomena are undesirable since, in many cases, the parts are utilized in environments where close tolerances are necessary.

One way of eliminating burrs and flashing is by utilization of a grinding device. With such devices, the piece to be worked is typically mounted on a table over which a fast-moving abrasive surface is passed. The abrasive surface is made to come into engagement with the piece in order to remove the undesirable appendages.

The discussion heretofore is illustrative of one application to which a grinding device can be put. Innumerable other applications exist for such devices, however.

There are two basic classifications of grinders. These include disc or wheel grinders and belt grinders. The former type utilizes an abrasive wheel formed from a carbon, silicon, or other gritty material. The latter type employs a drive wheel over which a belt run, having an outwardly facing abrasive surface, can be fitted. Typically, the belt run also extends over an idler wheel. The abrasive belt is made to engage the workpiece proximate the drive wheel.

Regardless of the type of grinder involved, however, any one particular apparatus in the prior art is a dedicated device. That is, if it is designed to perform a wheel grinder function, it is not capable of being utilized for belt grinding. Similarily, if it is designed to serve a belt grinding function, it is incapable of performing as a wheel or disc grinder.

Another problem basic to both types of grinders is that of useful operational life. Because of the very adverse circumstances to which grinding wheels and belts are exposed, deterioration is a constant concern, and this is true regardless of the abrasive substance utilized.

It is to these problems in the prior art and desirable features that the present invention is directed. It offers a grinding attachment structure which is both versatile and durable. Not only does it extend belt life, but it also renders grinding operations more efficient.

SUMMARY OF THE INVENTION

The present invention is an attachment for use in combination with a table on which a workpiece to be ground is positioned. The attachment includes a contact wheel which has a radially outwardly facing annular surface about which a grinding belt can be run. Typically, the belt would also extend around an idler wheel mounted at a distance from the contact wheel and disposed for rotation about an axis generally parallel to an axis about which the contact wheel would rotate. The abrasive grinding surface of the belt would face outwardly. Further, the attachment includes a grinding wheel made of an appropriate abrasive material. Means are provided for supporting either the contact wheel or the grinding wheel at a location proximate the table where the workpiece is mounted. The particular wheel so supported would be disposed for rotation about an axis so that movement of the particular grinding surface can be effected.

In a preferred structure, a plurality of idler wheels can be provided and be used in the belt grinder configuration. The preferred embodiment employs three such idler wheels, and the wheels are aligned with each other and the contact wheel, when that wheel is mounted to a drive spindle, so that the belt can be fed around portions of each of the wheels.

The idler wheels can be positioned relative to the contact wheel and each other so that the belt is made to run a sinuous course as it departs from the contact wheel and returns thereto after passing around the various idler wheels. In the preferred embodiment, the belt run passes around a first idler wheel with a side of the belt opposite the outwardly facing abrasive surface engaged by that wheel. Thereafter, the belt is made to pass around a second idler wheel with the outwardly facing abrasive surface of the belt engaged by that wheel. Finally, the belt is passed around the third idler wheel with the underside of the belt again engaged by the third wheel.

A number of advantages are, thereby, obtained. Depending upon specific placement of the various idler wheels and contact wheel, a significantly greater length of belt can be fitted into a much smaller area. Consequently, the life of the belt can be expanded without being required to expand the size of the housing in which it is contained.

Additionally, it has been found that, by feeding the belt back upon itself as is done in looping it around the various idler wheels as described above, a cleaning function is accomplished. This reverse flexing helps to dislodge particulate matter from workpieces which has become embedded between the grit of the abrasive belt. Not only is more efficient grinding accomplished thereby, but longer belt life is further facilitated.

The present invention is, thus, an improved grinding attachment which solves many of the problems existent in the prior art. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
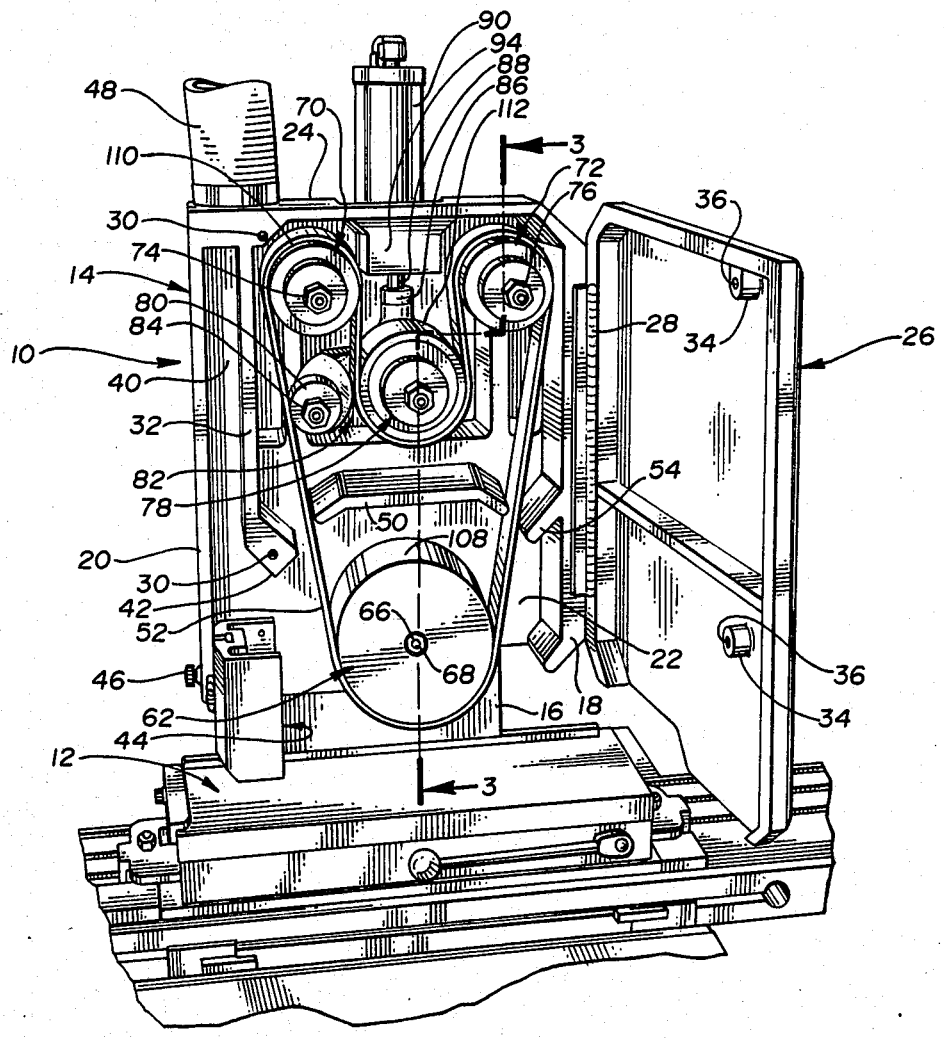
FIG. 1 is a perspective view of the present invention illustrating the attachment configured as a belt grinder.

Referring now to the drawings wherein like reference numerals denote like elements throughout the several views, FIG. 1 illustrates an attachment 10 in accordance with the present invention configured for usage as a belt grinder. Grinding attachments, as used in the prior art, are mounted with reference to a table or support on which a workpiece to be ground is placed or mounted. In order to effect grinding of the piece at appropriate locations, the table is typically disposed for movement in directions along three mutually perpendicular axes. The grinding surface can, thereby, be brought to bear upon all aspects of the piece.

The present invention is intended to be utilized with such workpiece mounting structure. FIG. 1, therefore, illustrates such a table 12 and related controls and supporting structure.

The invention includes a housing 14 mounted to the table support structure by an appropriately constructed bracket 16. The housing 14 includes right and left side walls 18, 20, a back wall 22, and a top 24. A front wall of the housing 14 is defined by a door 26 which can be hinged to the right side wall as at 28. The bottom of the housing 14 is open so that the abrasive element carried therewithin can be brought into engagement with the workpiece on the table 12 immediately below.

As best seen in FIG. 1, internally threaded apertures 30 can be formed in and proximate a partition 32 within the housing 14. Lands 34 can be formed on the inside of the housing door 26 and have apertures 36 passing therethrough with externally threaded bolts (not shown) carried within those apertures 36. Ends of the bolts extending external to the housing 14 when the door 26 is closed can carry grasping handles 38 to facilitate manual rotation. When the door 26 is closed, the apertures 36 in the lands 34 will register with the apertures 30 proximate the partition 32, and the bolts can be tightened within the internally threaded apertures 30 to secure the door 26 in a closed configuration.

The partition 32 is, as seen in the embodiment of FIG. 1, provided within the housing 14 to define a flue 40 therewithin. A lower end of the partition is flared away from the left side wall, as at 42, so as to enlarge the intake to the flue 40 and, thereby, facilitate entry of dust and other particulate matter generated by the grinding process.

While the flue 40 is positioned along the left side of the interior of the housing 14, it will be understood that such an arrangement is not exclusive. Placement of the flue 40 on the left in the particular embodiment illustrated was so made, since the direction of rotation of a grinding wheel, in a disc grinder application, or a contact wheel, in a belt grinder application, is in a clockwise direction as viewed in FIG. 1. The dust and particulate matter will, therefore, be impelled to the left.

A splash shield 44 can also be provided to contain the particulate matter to a large extent within the housing 14 and to deflect it upwardly into the flue 40. Location of the splash shield 44 can be made adjustable, and an appropriate adjustment knob 46 can be provided for this purpose.

Dust and particulate matter generated by the grinding process are deflected into the flue 40 by the shield 44, and other particulate materials are impelled into the flue 40, therefore, because of the direction of rotation of the grinding wheel, in one application, and the contact wheel, in another. All the materials entering the flue 40, however, will be drawn upwardly because of the provision of a vacuum source applied to the housing 14 through an aperture (not shown) in the top 24 of the housing 14 through which communication to the flue 40 is provided. A flexible hose 48 is mated to the outside of the housing 14 to render establishment of the vacuum within the flue 40 and to receive and dispose of the byproducts of the grinding process. The hose 48 communicates with vacuum generation means (not shown) at its opposite end.

Various other deflector partitions can also be provided within the housing 14. For example, a partition 50 can be oriented generally horizontally between the upward and downward runs of a grinding belt 52 when the attachment is configured as a belt grinder. Additionally, a small partition 54, generally symetrical with the flared portion 42 of the flue defining wall 32, can be provided. With partitions so structured, dust and other particulate matter generated by the grinding operations will not only be directed into the flue 40, but they will also be obstructed from entering up into the central upper portion of the housing 14 which encloses more sensitive pneumatic structure as will be defined hereinafter.

Figure 3:
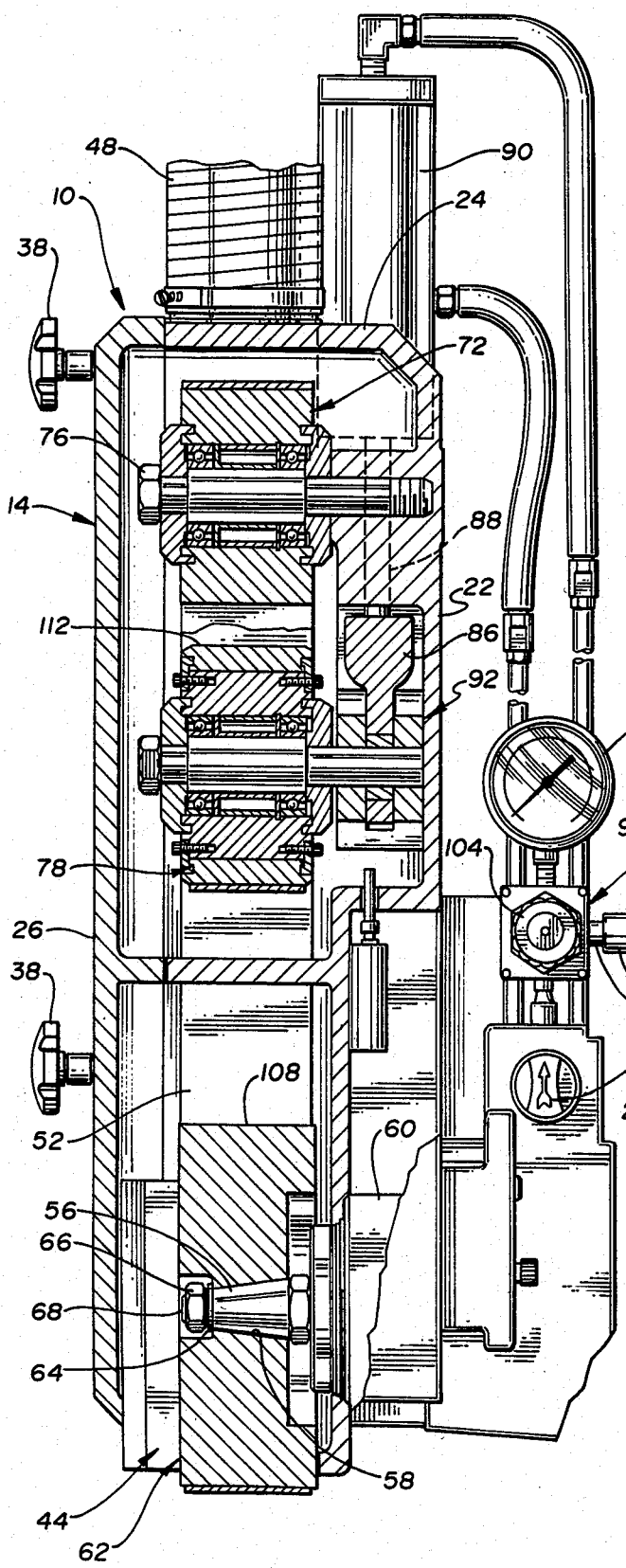
FIG. 3 is a sectional view taken generally along the line 3—3 of FIG. 1.

Referring now to FIG. 3, a conventional tapered drive spindle 56 is provided within the bottom portions of the housing 14 and extending into the housing 14 from the rear wall 22 thereof. When the attachment 10 is to be configured as a belt grinder, a contact wheel aperture 58, sized and contoured closely similar to the external contours of the drive spindle 56, is fitted over the spindle 56 so that rotation of the spindle 56 initiated by a motor 60 will be translated to the contact wheel 62. The contact wheel 62 is maintained on the spindle 56 by a lock washer 64 and nut 66 tightened onto an externally threaded protuberance 68 of the spindle 56.

Uppermost within the housing 14 are disposed two fixed positioned idler wheels 70, 72. As viewed in FIG. 1, a first of these idler wheels 70 is in the left uppermost corner of the housing 14 proximate the upper end of the flue 40. The other idler wheel 72 is disposed in the right uppermost corner of the housing 14. These idlers 70, 72 are free-wheeling and are not powered. Rather, they merely function as guides over which an abrasive belt 52 can be fed as will be discussed hereinafter. These wheels 70, 72 can be affixed to the respective shafts on which they rotate by any appropriate means such as nuts 74, 76 tightened onto externally threaded ends of the shafts.

A tensioning idler 78 is diposed between, and at a position lower within the housing 14, with respect to the two fixed idlers 70, 72. The tensioning idler 78, as are the fixed idlers 70, 72, is mounted for rotation about an axis generally parallel to the axis about which the drive spindle 56 is made to rotate. Additionally, the tensioning idler wheel 78 and the fixed idler wheels 70, 72 are aligned with the contact wheel 62, when that wheel 62 is mounted to the spindle 56, so that the abrasive belt 52 can be fed around portions of each of the various wheels 62, 70, 72, 78.

Unlike the fixed idlers 70, 72, however, the tensioning idler 78 is disposed for movement toward and away from the contact wheel 62. The hub 80 of a tension pivot arm 82 which carries the tensioning idler 78 is mounted for pivoting about an axis generally parallel to the axes about which the various wheels rotate. The hub 80 is secured to a shaft (not shown) by appropriate means such as a nut 84 for rotation about the axis. The tensioning idler 78 is mounted at an end of the pivot arm 82 remote from the hub 80. The idler 78 is, therefore, free to move through an arc about the hub 80.

The pivot arm 82, however, is provided with a length so that a sleeve 86 extending upwardly from the main casing of the tensioning idler 78 is able to receive a telescoping shaft 88 extending downwardly from a pneumatic tensioning cylinder 90. The idler 78 receives that shaft 88 by way of a coupling 92 including the sleeve 86 as best seen in FIG. 3.

The pneumatic cylinder 90, as best seen in FIG. 3, is positioned atop the attachment housing 14 and is seated within a recess 94 formed therewithin. The cylinder 90 can be secured to the housing 14 by any appropriate means.

Cylinder control apparatus is secured to the rear wall 22 of the housing 14. The controls include an on/off switch 96 and a pressure regulator 98 in-line in a conduit 100 mated to an air supply hose (not shown) by a coupling 102. The regulator includes a manually graspable handle 104 to facilitate the regulation of air pressure.

Conduits by which air is introduced into the tension cylinder 90 and bled therefrom extend from the pressure regulator 98 to the cylinder 90. A pressure gauge 106 is provided so that an operator of the grinding attachment in accordance with the present invention can ascertain the measure of tension being exerted upon the abrasive belt 52.

As one will see in view of this discussion, the pneumatic cylinder 90 imparts generally vertical reciprocal movement to the tensioning idler 78, while the tension pivot arm 82 would tend to limit the idler to movement in an arc. The idler movement can be reconciled by providing a generally horizontal slot (not shown) in the coupling 92 by which the idler 78 is linked to the tension cylinder shaft 88. As the shaft 88 is reciprocated generally vertically, therefore, and the idler 78 is commensurately reciprocated along a generally vertically extending axis, the idler 78 will concurrently be pivoted about the axis of the pivot arm 82. This pivoting will, of course, tend to move the idler 78 slightly laterally, but the lateral movement will be accommodated by the slot.

When the operator of the attachment wishes to configure the apparatus as a belt grinder, the pressure regulator 98 is adjusted to withdraw the tensioning idler 78 upwardly. The grinding belt 52 can, thereafter, be fed about an annular, outwardly facing surface 108 of the contact wheel 62. The abrasive side of the belt 52 would, of course, be made to face outwardly.

The run of the belt 52 can be made to extend from the contact wheel 62 to the first fixed idler wheel 70 and about a portion of that wheel with the inwardly facing surface of the belt 52 being engaged by a portion of the annular, outwardly facing surface 110 of that idler 70. The belt 52 can, thereafter, be fed about the tensioning idler 78 with the abrasive surface being engaged by the annular surface 112 of that idler 78. The run can continue about the other fixed idler 72 with the abrasive surface facing outwardly from the idler 72. Finally, the belt 52, being endless, would extend back to the contact wheel 62. With the belt 52 in proper position with respect to the various idlers 70, 72, 78 and the contact wheel 62, the pressure regulator 98 is manipulated to extend the tension cylinder shaft 88 so that the belt 52 is brought under an appropriate measure of tension.

As can be seen, a belt 52 so fed runs a sinuous course. This sinuous feeding serves a number of purposes. First, it enables a longer run of abrasive belt 52 to be employed in the attachment 10 without being required to enlarge the housing 14. More belt length translates into longer belt life.

Additionally, it has been found that, by doubling the belt 52 back upon itself with the abrasive side in engagement with the surface 112 of the tensioning idler 78, cleaning of the belt 52 is facilitated. This flexure tends to loosen particles that have become embedded between the grit of the belt 52, and, as a result, when the belt 52 again runs over the right uppermost fixed idler 72, the particles become dislodged from the belt 52. This again extends belt life.

Finally, by extending the belt 52 over the contact wheel 62 and three idler wheels 70, 72, 78, greater stability is achieved. More track surface is made available to hold the belt 52 in its desired location.

Figure 2:
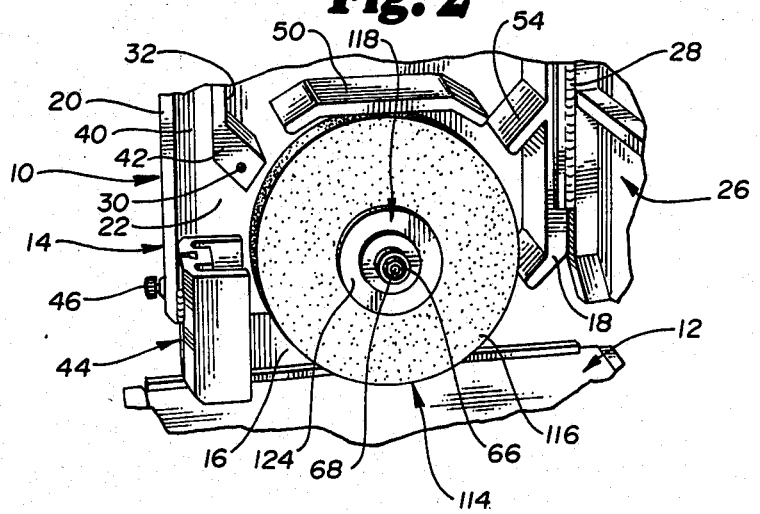
FIG. 2 is an enlarged perspective view, similar to a portion of FIG. 1, illustrating the attachment configured as a wheel grinder.
Figure 4:
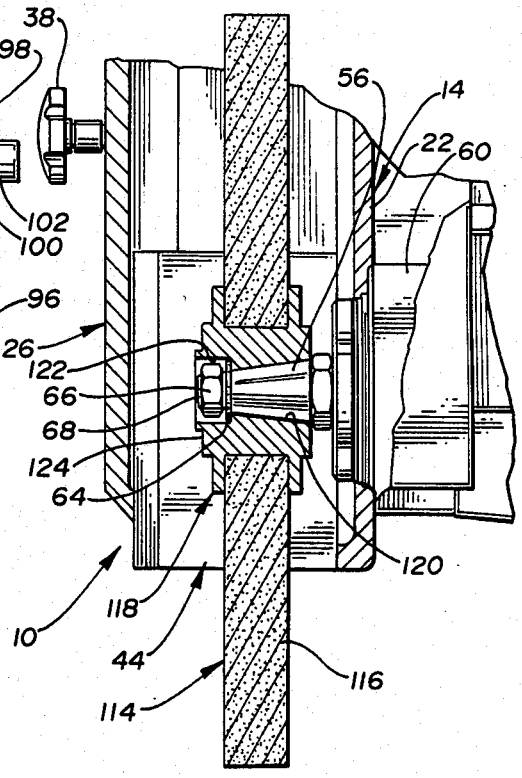
FIG. 4 is a sectional view, similar to FIG. 3, but for the attachment configured as a wheel grinder.

Because of the structure of the attachment 10, it can, if desired, be reconfigured as a disc or wheel grinder. FIGS. 2 and 4 illustrate such a configuration.

When it is desirable or necessary to make such a reconfiguration, the operator of the attachment would manipulate the regulator 98 to withdraw the tensioning idler 78 upwardly. With that idler 78 so withdrawn, enough slackness would exist in the belt 52 in order to enable it to be removed from the various idlers 70, 72, 78 and contact wheel 62. The contact wheel lock washer 64 and securing nut 66 can then be removed in order to enable dismounting of the contact wheel 62 from the drive spindle 56.

With the spindle 56 bare, a bonded abrasive grinding wheel 114, as seen in FIGS. 2 and 4, can be mounted. Typically such a wheel 114 includes an abrasive material 116 as carried by a wheel collet 118 forming a hub of the disc grinding fixture 114.

The collet 118, as seen in FIG. 4, has an aperture 120, sized and contoured closely similar to the external contours of the drive spindle 56, formed therein. Additionally, it includes an annular recess 122 in its outwardly facing wall 124. With the collet 118 so structured, therefore, it can be fitted over the spindle 56 and tightly secured thereto by use of the lock washer 64 and securing nut 62 so that the spindle rotation can be translated to the abrasive wheel fixture 114.

As can be seen then, the present invention provides a grinding attachment 10 which can be interchangeably configured as both a belt grinder and a disc or wheel grinder. It is, therefore, much more versatile than grinder attachments known in the prior art. Additionally, it is significantly more durable, when used in its belt grinder configuration, because of the advantages obtained as discussed hereinbefore.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. An apparatus for precision grinding of selected workpieces positioned on a workpiece mounting structure, the interaction of said apparatus and said workpieces producing grinding particulate comprising:

a semi-enclosed housing having a rear-wall, top wall, opposed sidewalls, and a selectively removable front wall, said housing defining a lowermost grinding port;

a drive spindly rotatably mounted within said housing, said drive spindle adapted for selectively, interchangeably mounting a detachable grinding wheel and a contact wheel having an annular surface adapted for supporting an endless grinding belt, said drive spindle defining a drive spindle axis of rotation located above said grinding port a distance less than the radius of either of said grinding wheel and said contact wheel;

a plurality of idler wheels rotatably mounted within said housing above said drive spindle, said idler wheels adapted for selectively, removably receiving said endless grinding belt supported by said contact wheel, each of said idler wheels having an annular surface about which the endless belt can be run when said contact wheel is mounted to said spindle and the belt is fed around said surface of said contact wheel, said idler wheels being positioned relative to said contact wheel and each other wherein the run of the belt from a first of said idler wheels to which the belt is fed from said contact wheel, back to said contact wheel is diverted by a second and said idler wheels;

particulate deflection means interposed between said drive spindle and said idler wheels, comprising a first deflection plate extending substantially from said rear wall to said front wall, a flue defining plate extending downwardly from said top wall to a point below said first deflection plate and extending substantially from said rear wall to said front wall, said flue defining plate positioned proximal to and spaced apart from one of said sidewalls to define a flue, and a second deflection plate extending downwardly and inwardly from the other of said sidewalls to a point below said first deflection plate and extending substantially from said rear wall to said front wall;

said first deflection plate, said flue defining plate, and said second deflection plate being respectively spaced apart from each other to define first and second belt clearing gaps whereby said endless belt clears said particulate deflection means when said endless belt is supported within said housing by said contact wheel and said idler wheels, said particulate deflection means directing said grinding particulate from said workpiece to said flue.

2. An apparatus as claimed in claim 1, said first deflection plate comprising a generally horizontal center panel, and opposed, downwardly flared end panels operably coupled to said center panel, said first deflection plate oriented generally symmetrically about a vertical axis intersecting said drive spindle axis of rotation.

* * * * *

UNITED STATES PATENT AND TRADEMARK OFFICE

CERTIFICATE OF CORRECTION

PATENT NO. : 4,662,116

DATED : May 5, 1987

INVENTOR(S) : Homi K. Erani

It is certified that error appears in the above-identified patent and that said Letters Patent is hereby corrected as shown below:

Column 7, line 5, delete the word "spindly" and substitute therefor --spindle--.

Column 7, line 27, delete the word "and" and substitute therefor --of--.

Signed and Sealed this

Third Day of November, 1987

*Attest:*

DONALD J. QUIGG

*Attesting Officer*

*Commissioner of Patents and Trademarks*